United States Patent [19]

Nitzberg

[11] Patent Number: 4,568,126

[45] **Date of Patent: * Feb. 4, 1986**

[54] METHOD AND MACHINE FOR REMOVING BLOCKAGE AND SILT FROM ABANDONED AUGER HOLES

[75] Inventor: Leonard R. Nitzberg, Knoxville, Tenn.

[73] Assignee: Patent Development, Ltd., Knoxville, Tenn.

[ * ] Notice: The portion of the term of this patent subsequent to Feb. 4, 2001 has been disclaimed.

[21] Appl. No.: 196,200

[22] Filed: Oct. 14, 1980

[51] Int. Cl.[4] ..... E21C 35/20; E21D 10/00

[52] U.S. Cl. ..... 299/1; 299/56; 175/62; 15/104.18

[58] Field of Search ..... 172/26.5, 22.6; 37/62; 15/104.16, 104.18, 104.19; 175/62; 299/56, 1

[56] References Cited

U.S. PATENT DOCUMENTS

| | | | |
|---|---|---|---|
| 1,788,094 | 1/1931 | Fletcher | 15/104.18 |
| 2,038,170 | 4/1936 | Flavin | 15/104.18 |
| 2,719,708 | 10/1955 | Compton | 299/56 |
| 3,260,054 | 7/1966 | Lorenz | 175/62 |
| 3,443,649 | 5/1969 | Atkins et al. | 175/62 |
| 3,525,112 | 8/1970 | Masters | 15/104.12 |
| 4,142,082 | 11/1978 | Garvin | 175/62 |
| 4,150,853 | 4/1979 | McCoy | 299/18 |
| 4,322,897 | 4/1982 | Brassfield | 37/62 |

*Primary Examiner*—James A. Leppink
*Assistant Examiner*—Bruce M. Kisliuk
*Attorney, Agent, or Firm*—Pitts and Brittian

[57] ABSTRACT

A method and machine for removing blockage and silt from abandoned auger holes preparatory to mining a portion of the remaining ore or preparatory to the placement of charges in said holes. Initially, the highwall is faced up by removing blockage proximate and external to the auger hole as with conventional earth moving equipment. The blockage from within the mouth of the auger hole is removed to expose blockage deposited within the auger hole at locations spaced from the auger hole mouth. Blockage at locations spaced from the auger hole mouth is removed by a apparatus which collapses to penetrate the blockage and is deployed to engage the blockage such that as the machine is withdrawn from the auger hole, the blockage is removed therewith. A device is provided for completing the auger hole cleaning operation by entraining silt or other contaminates in a stream of water and collecting the silt laden water which is transported and discharged at a remote location.

11 Claims, 7 Drawing Figures

METHOD AND MACHINE FOR REMOVING BLOCKAGE AND SILT FROM ABANDONED AUGER HOLES

BACKGROUND OF THE INVENTION

This invention relates to mining operations and more particularly concerns a method and machine for removing blockage and silt preparatory to mining a portion of the remaining ore at a mining site, or preparatory to the placement of explosive charges in an auger hole for reclammation purposes.

Auger type surface mining has been employed extensively in recent years at locations where overburden removal costs or other considerations preclude further surface mining. Since auger mining severely undermines support for the overburden, further blasting for overburden removal in augered zones produces contaminated ore. Even at mining sites in which technological improvements have reduced the contaminates produced, the danger associated with additional blasting in augered zones because of the collapse of the overburden precludes further surface mining. For these reasons, augered seams have simply been abandoned and when not required by law, left without reclamation. Recent statutes have, however, required that auger holes be covered to reduce hazards to children.

Weathering causes abandoned seams to undergo detrimental changes. For example, the exposed highwall deteriorates and fragments above the auger hole which causes sloughing. The sloughing generally contains large rocks, decomposed shale and eroded surface soil which accumulate at the base of the highwall and at times spill into and seal the mouth of the holes. Since coal is generally found between deposits of shale and sandstone, it often occurs proximate ground water. This ground water fills the auger holes which are impounded by the sloughing and deposits slit by a precipitus action. The silt is deposited adjacent the highwall side of the water impoundments and at low points along the length of the auger holes. This siltation tends to build rapidly and may partially fill up to 30 lineal feet of the auger hole in a period of ten years. Further, the siltation continues to accumulate until the auger hole is completely filled. Recent developments in mining and demolition have enabled further mining of existing auger holes, but applications of this new technology is contingent upon certain specifc auger hole environment conditions. In order to extract commerically saleable ore from the previously mined auger holes, the ore must be relatively free of contaminates. Additionally, access to the holes must be readily available. Accordingly, it is necessary to have a relatively clean auger hole environment in order to produce saleable ore from the pre-existing holes.

In blasting mining operations, access and hole size consistency are important for the physical sizing and deployment of the charges. In this connnection, it is necessary to develop commerically feasible methods for removing blockage and contaminates from auger holes which may have been worn during the mining operation into elliptical cross-sectional configurations, especially at the entry of the holes. Further, statuatory and safety restrictions prevent persons from entering the auger holes thereby necessitating a method for cleaning the auger hole which can be operated from a location remote from the hole confines.

OBJECTS OF THE INVENTION

Accordingly, it is an object of the present invention to provide a method and machine for removing blockage and contaminates from abandoned auger holes. More specifically, it is an object of this invention to provide a method and machine for removing sloughing and blockage consisting of rock, dirt or the like from locations proximate and external to the auger hole and from within the mouth of the auger hole. Further, it is an object of the invention to provide a method and apparatus for removing silt deposits which exist within certain abandoned auger holes regardless of the slope of said holes. Another object of the invention is to provide a method and apparatus for removing silt deposits from holes which may be dry, partially flooded, or completely flooded. Still another object of the invention is to provide a method and apparatus for removing blockage and contaminates from abandoned auger holes which are commerically feasible and labor saving. Yet another object of the invention is to provide a method and apparatus for removing blockage and contaminates by operation of a remotely controlled apparatus such that people are not required to enter the holes during the cleaning operations. Further objects and advantages of the invention will become apparent upon reading the detailed description together with the drawings which are described as follows.

SUMMARY OF THE INVENTION

Accordingly, a method for removing blockage and contaminates from auger holes is disclosed which comprises the steps of facing up the highwall by removing blockage proximate and external to the auger hole. Blockage deposited within the mouth of the auger hole is then removed until the auger hole assumes its proximate cross-sectional outline prior to its presence of said blockage. Silt deposited at depths within the auger hole beyond the blockage proximate the mouth of the auger hole is then removed. In one embodiment the silt is removed by directly a stream of water against the silt such that the stream dislodges the silt particles and suspends the particles in water. The silt laden particles are collected and transported to a location remote to the auger hole.

A machine is provided for being drivingly mounted on a conventional earth moving machine for removing blockage from an auger hole. The apparatus includes a body member which is drivingly connected to the conventional earth moving machine. This body member carries a blockage removal implement which serves to contact and dislodge blockage from within the auger hole. In one embodiment the blockage removal implement is collapsable such that its cross-sectional area is reduced for insertion through the blockage preparatory to removal. During the removal operation the blockage removal implement can be deployed such that its cross-sectional area is increased to enhance the efficiency with which the blockage is removed.

DESCRIPTION OF THE PREFERRED EMBODIMENT

Figure 2:
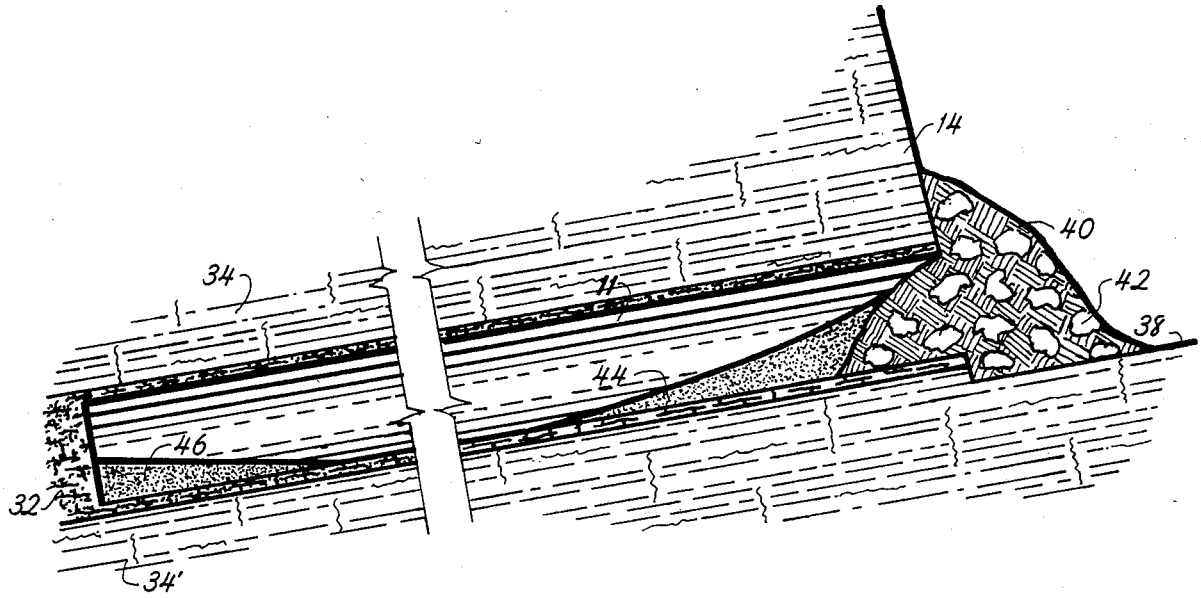
FIG. 2 is an elevation view of an exemplary abandoned auger hole illustrating certain of the sloughing and siltation contaminates.
Figure 4:
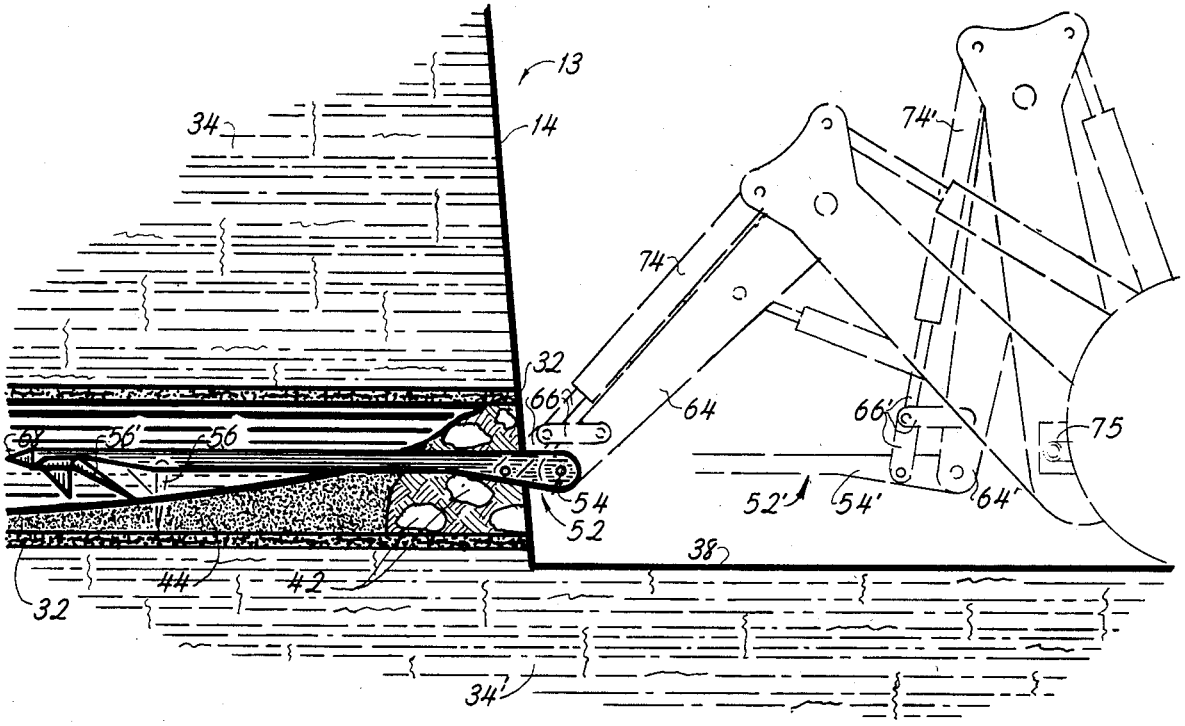
FIG. 4 is an elevation view of an exemplary auger hole depicting the operation of the apparatus illustrated in FIG. 3.

Referring now to the drawings, a method and machine are disclosed for removing blockage and contaminates from abandoned auger holes such as the auger hole 11 depicted in FIG. 2. The auger hole is a substantially horizontally disposed void which is created by mining a seam of ore or other hard materials such as coal. The auger hole generally commences at a highwall 13 or other man-made cliff formation created during mining operation. This highwall terminates along its lower edge at the bench 38 which supports the mining equipment during mining operations. The highwall face 14 is substantially coplanar with the termination of the seam 32 of the coal or other material which is to be mined. As illustrated in FIGS. 2 and 4, the auger hole continues inwardly from the highwall along the length of the coal seam.

Figure 1:
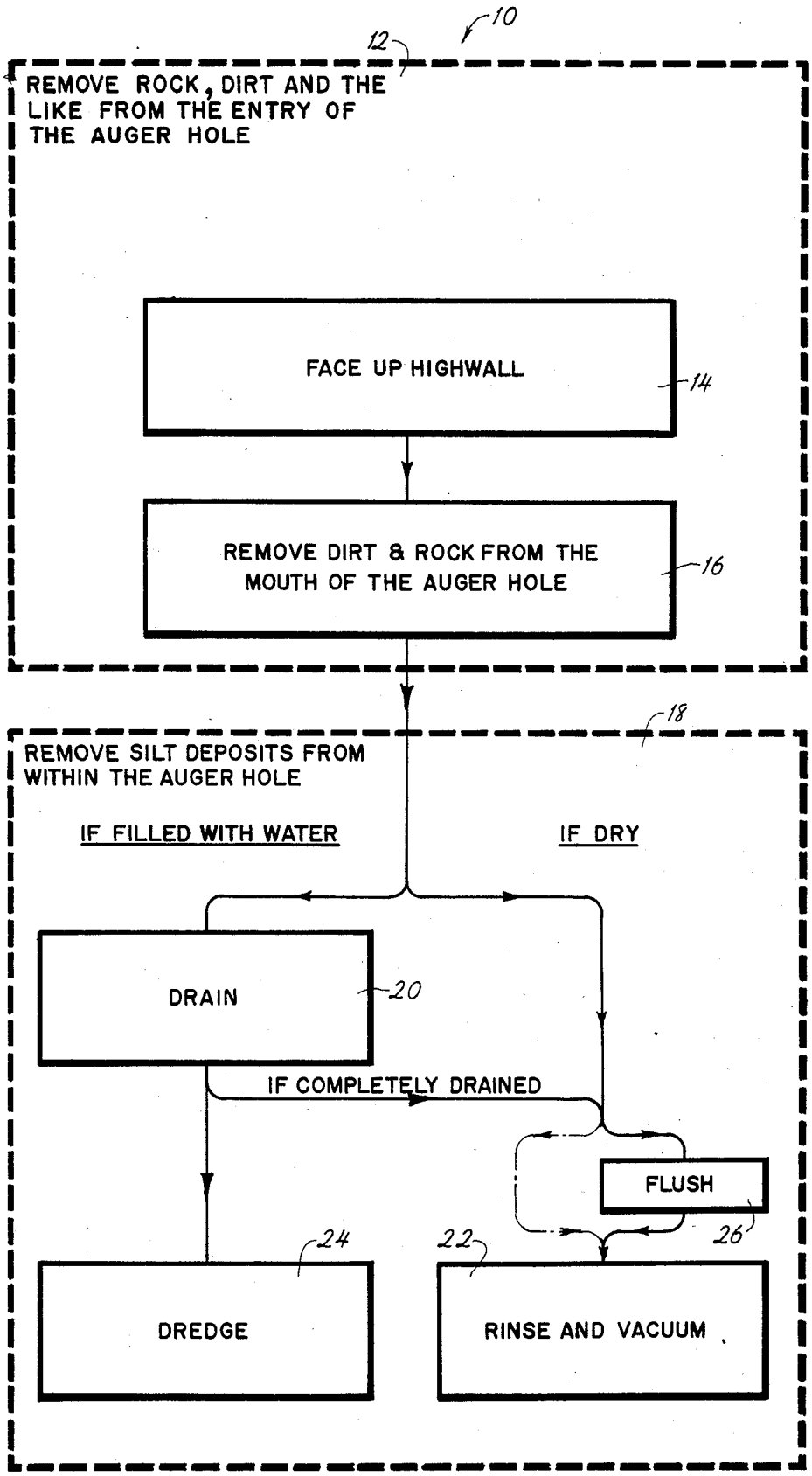
FIG. 1 is a block diagram illustrating various features of the method of the present invention.

A method for removing blockage, contaminates, and silt from abandoned auger holes preparatory to mining a portion of the remaining ore, in-situ mining or preparatory to the placement of explosive charges in the auger hole for reclamation purposes is indicated generally at 10 in FIG. 1. This method includes the step of facing up the highwall as by removing blockage proximate the mouth of the auger hole and external to the auger hole. In this manner, access to the auger hole can be gained by equipment necessary to complete the cleaning of the auger hole of its blockage and contaminates such as silt.

Upon completion of the facing operation, blockage from within the mouth of the auger hole, that is at the location at which the auger hole opens onto the highwall, is removed. Upon removal of the blockage proximate the auger hole mouth, the auger hole mouth assumes a cross-sectional outline substantially equivalent to the cross-sectional outline of the auger hole mouth prior to the presence of the blockage.

As indicated in the method diagram of FIG. 1 at 18, silt deposits and other contaminates are removed from the auger hole subsequent to clearing the auger hole mouth. In the event the auger hole contains water or other liquids, the auger hole is first drained as indicated at 20 and dredged as indicated at 24. The dredging operation immediately follows the draining operation in the event the draining operation does not completely remove the liquids from the auger hole.

In the event the auger hole is initially dry and the draining operation substantially removes all of the liquids from the auger hole, the auger hole is then flushed as indicated at 26 with high pressure stream of liquid, such as water. The flushing dislodges siltation blockage from the dry hole walls and floor where such blockage restrict and prevent the deployment of the mechanism for rinsing and vacuuming the auger hole as indicated at 22 in FIG. 1. In the event such siltation blockages are not present, the flushing of the hole is not necessary as illustrated by the phanthom line, prior to the rinsing and vacuuming operations which prepare the auger hole for the placement of explosive charges or for the insertion of additional mining equipment to remove a portion of the remaining ore.

In an exemplary auger hole indicated at 11 in FIG. 2, the auger hole is illustrated as a void which is substantially circular in cross-sectional outline. However, it will be recognized that the cross-sectional outline may assume various geometries such as an ellipse, rectangle, etc. The auger hole is cut into a seam of coal 32 which rests between layers of overburden and underburden 34 and 34', respectively, such as shale, sandstone, clay, or the like and extends from the face 14 of the highwall 13 inwardly along a substantially horizontal line to depths up to 200 feet or more. The auger hole 11 generally has a diameter which is slightly smaller than the boundaries of the coal seam such that the coal removed from the seam is not contaminated with the surrounding overburden or underburden. The slope of the auger hole can vary upwardly or downwardly from the face of the highwall, and it will be recognized that the auger holes sloping upwardly towards the mouth thereof, are more apt to trap large quantities of liquid contaminants such as water.

Subsequent to the abandonment of a mining site, the highwall 14 undergoes a weathering process as by the action of rain, frost, erosion, etc. and gradually decomposes. Portions of the highwall separate and are deposited on the bench 38 as sloughing 40. Additionally, this sloughing tends to intrude into the mouth of the hole. The sloughing 40 creates a water resistance blockage and impounds the auger hole thereby trapping water. With the passage of time, silt particles existing in the water and/or entrained in the water from the sloughing are deposited as at 44 adjacent the sloughing 40 on the floor of the auger hole and at other low points in the auger hole as at 46.

Figure 3:
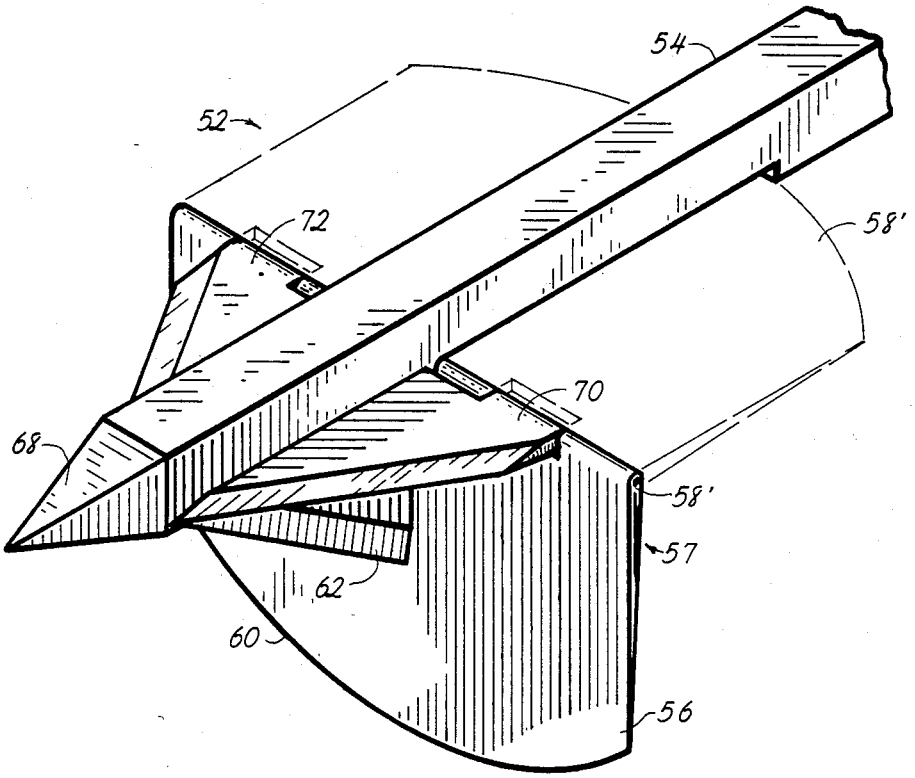
FIG. 3 is a perspective view of an apparatus suitable for being drivingly mounted on a conventional earth moving machine for removing blockage from the mouth of an auger hole.

In the preferred embodiment, the highwall 14 in FIG. 4 is faced up by clearing sloughing proximate the auger hole mouth until the upper surface of the bench 38 is exposed, by using conventional earth moving equipment. In this operation, additional sloughing 42 may intrude into the mouth of the auger hole. Subsequent to facing up the highwall by removing the blockage proximate and external to the auger hole, the blockage 42 which generally contains large amounts of rock, dirt and ore, is removed from the auger hole mouth. In this connection, a machine generally indicated at 52 in FIG. 3 is provided. This machine is suitable for being drivingly mounted on conventional earth moving machines such as a backhoe and includes a body member 54 which is pivotally connected as indicated in FIG. 4 to the conventional earth moving equipment. This body member carries a blockage removal implement generally indicated at 57 which is collapsable such that its cross-sectional area is reduced for insertion through the blockage preparatory to the removal of the blockage. The implement can be deployed during removing operations such that its cross-sectional area is increased to enhance the efficiency with which the blockage is removed. More specifically, in the illustrated embodiment the blockage removal implement includes a blade 56 which is pivotally connected to the body member through the hinge pin 58. The blade defines a curved lowermost surface 60 which preferably conforms to the lowermost cross-sectional boundary of the auger hole to facilitate movement of the machine from the auger hole as blockage is withdrawn.

During insertion of the blockage removal implement through the blockage, the blade 56 is collapsed to the position generally indicated at 56' with the phantom lines (See FIG. 3) by the resisitive action of the blockage on the implement. Thus, the blade is placed in an inserting mode having a reduced cross-sectional outline which facilitates insertion through the blockage. Upon positioning the blade at the desired location along the length of the auger hole, the blockage removal implement is withdrawn and the resistive action of the blockage on the blade moves the blade to the location indicated in FIG. 3 such that the rearward surface of a blade contacts the blockage and engages the blockage for removal purposes as the implement is withdrawn from the auger hole.

Stops are provided for limiting the movement of the collapsable blade and for positioning the blade in the inserting and deployment modes. More specifically, in the illustrated embodiment the body member 54 serves as a stop for the blade while it is being inserted into the auger hole. The member 62 carried by the body member serves as a stop for the blade as it is being withdrawn from the auger hole.

The body member 54 as illustrated in FIG. 4 is drivingly connected to a conventional earth moving machine such as a backhoe illustrated at the locations 64 and 64'. The machine 52 is oriented by conventional positioning means 66 and 66' which serve to move the machine 52 along the axis of the auger hole. More specifically, the machine indicated at 52' is positioned, by operation of the backhoe, against the center of the blockage at the mouth of the auger hole and then advanced through the blockage until it reaches a preselected depth in the auger hole. To facilitate the advancement of the machine thorough the blockage, a piercing member 68 is defined on the forward end portion of the body member to create a passage for the earth moving implement in the material through which the implement is inserted. This action displaces the blade 56 to the position 56' thereby reducing the cross-sectional area of the blade. The cutting members 70 and 72 assist in widening the opening through which the implement is inserted and also support the hinge pin 58.

Upon positioning the implement at a desired location in the blockage or through the blockage the backhoe is operated for withdrawing the implement and in doing so the blade is acted upon by the resisitive action of the silt or blockage and pivots until it contacts the stop 62. This movement of the implement is imparted by the hydraulic orientation rams 74 and 75 during extraction. These rams are of conventional design and an integral part of conventional earth moving equipment such as a backhoe. It will be recognized by those skilled in the art that the blockage is generally not removed by a single stroke but by a series of increasingly longer strokes each of which removes a portion of the blockage.

Figure 5:
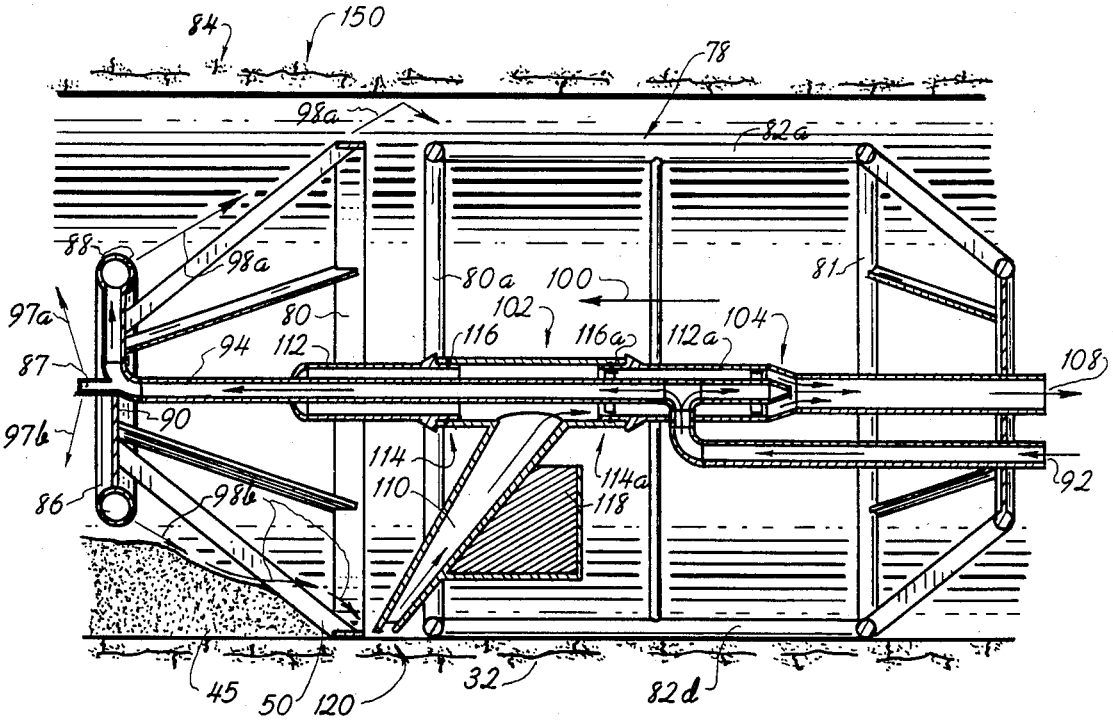
FIG. 5 is a sectional elevation view illustrating an apparatus constructed in accordance with various features of the present invention for removing silt from dry auger holes.
Figure 6:
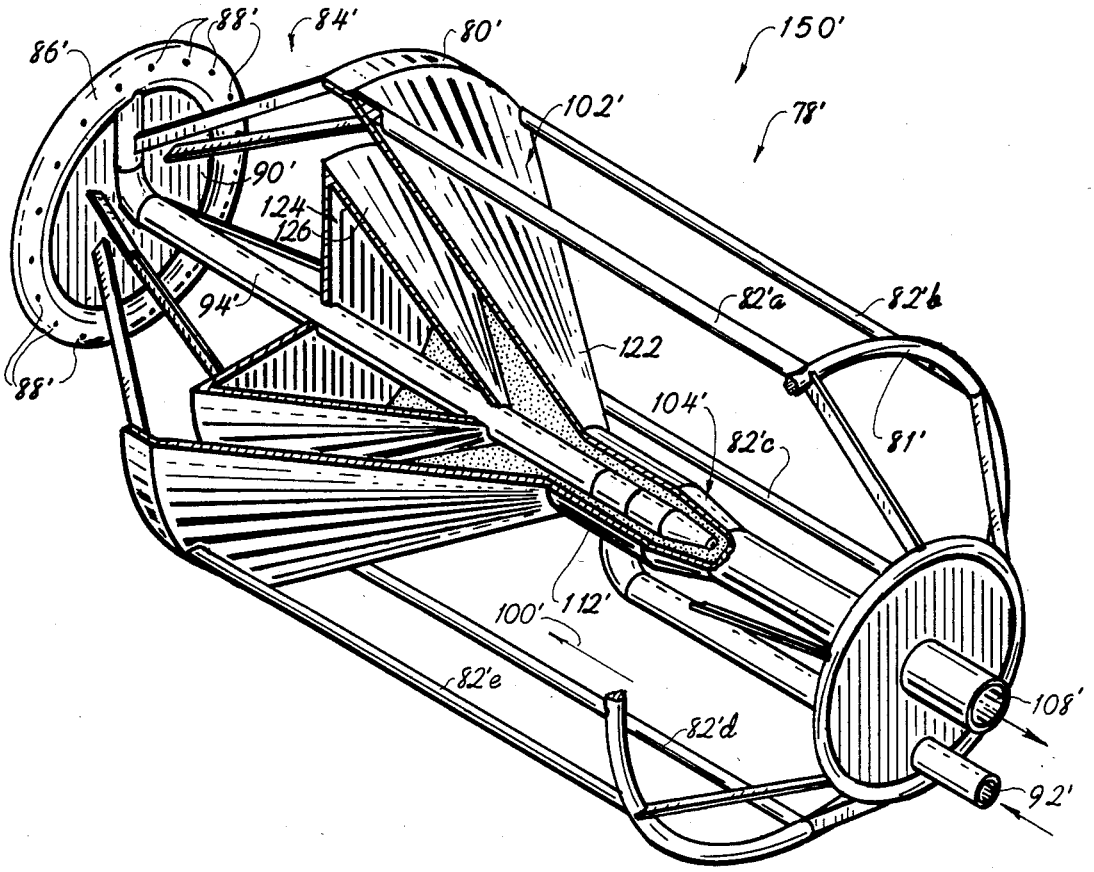
FIG. 6 is a perspective view partially in sections illustrating an apparatus for removing silt from partially or completely flooded auger holes.

As necessary or desired, silt can be removed from the auger holes subsequent to the blockage removal by a method and apparatus utlizing high pressured streams of water. Two embodiments of a device 150 and 150' similar in design and operation are depicted in FIGS. 5 and 6, respectively, for removing silt from the auger holes. Since the device depicted in FIG. 5 is similar in construction to the device in FIG. 6, primed numerals will refer to corresponding components. The device depicted in FIG. 5 is particularly suitable for operation in water free auger holes. The device depicted in FIG. 6 is designed for operation in flooded auger holes. Each device is substantially cylindrical in outline and includes body member indicated at 78. This body member includes a plurality of circular structural members 80 and 81 which act as skids to support the device during its movement along the length of the auger hole. More specifically, the machine depicted in FIG. 5 includes skids 80 and 81 which are bridged by longitudinal support members 82*a* and 82*d*. The embodiment depicted in FIG. 6 includes skids 80' and 81' which are bridged by longitudinal support members 82'*a*-82'*f*. These support members serve as supportive ribs which assist in preventing the skids from being entrapped in ridges which may be worn into the coal 32. A support member 84 and 84' connects the body members 78 and 78', respectively, to their respective high pressured sparger rings 86 and 86'. Each of these sparger rings 86 and 86' include a multiplicity of nozzles 88 and 88' which are rigidified by respective reinforcement plates 90 and 90'.

The opposite end portions of the body members 78 and 78' are substantially conical in outline and carry input ports 92 and 92', respectively. These ports are connected in fluid communication with a pressurized source of water 132 through conduit 96 (See FIG. 7). Water traveling through these ports enters the center conduits 94 and 94', respectively, which serve as structural members and provide support for their respective sparger rings. Water entering the sparger rings is sprayed through the ring nozzles generating high pressure water jets as indicated by the arrows 98*a* and 98*b* in FIG. 5. These jets create a force in the opposite direction to propel the machine in an inward direction as indicated by the arrows 100 for the machine body member 78 and 100' for the machine body member 78'. Moreover, the streams entrain silt which is present in the auger holes.

Collection means are mounted on each of the body members 78 and 78' and positioned for receiving silt laden water produced by the emission assemblies which includes the sparger rings and their respective nozzles. More specifically, the collection devices 102 and 102' are located on the body members 78 and 78', respectively, for receiving the flow of the slurry produced by the action of the streams generated by the sparger rings. The slurry is collected in one embodiment by means of a vacuum produced in a venturi type piping arrangement indicated at 104 and 104', respectively. This venturi piping arrangement is supplied with a high pressured stream of water through the input ports of the respective body members.

The collected slurry is then transported through a conventional conduit which serves to transport the slurry from the collection device to the output ports 108 and 108' of the body members 78 and 78', respectively.

In the embodiment depicted in FIG. 5, the removal of the silt and blockages can be enhanced by the addition of an auxilary sparger nozzle 87 indicated at the forward end portion of the sparger ring 86. This nozzle directs jets of high pressured water 97*a* and 97*b* laterally in front of the sparger rings 86 to enhance the silt removal.

The collection device 102 illustrated in FIG. 5 is designed to operate in unflooded auger holes. More specifically, an intake nozzle 110 is pivotally attached to jacketed portions 112 of the supportive center conduit 94 at the locations indicated at 114 and 114A. The joints created at 114 and **114*a* can be sealed with the sealing members 116 and 116*a*, respectively, such as an "O"—ring or the like which permits positioning of the intake nozzle with the body member 78. A counterweight 118 attached to the intake nozzle 110 assists in positioning the nozzle in a downward direction. The intake nozzle 110, which freely rotates within the void 120 provided in the body member 78, is guarded from the silt 45 depicted in FIG. 5 by the interference member 84. The circular skids 80 and 81** serve to maintain the nozzle at a spaced location from the coal and auger floor.

The collection device 102 of members 78' depicted in FIG. 6 is designed to operate in flooded auger holes. More specifically, a non-rotatable collection vessel 112 which is conical in outline in the depicted configuration, is fixedly attached to a jacketed portion 112' of the center support conduit member 94' and is positioned to receive clouds of entrained silt produced by the high pressured jets present in the auger hole. The void depicted at 124 serves as an intake nozzle and thereby collects entrained silt which is drawn therethrough by the operation of the venturi generated vacuum. The weep holes 126 are provided to increase the bouyancy of the device.

Figure 7:
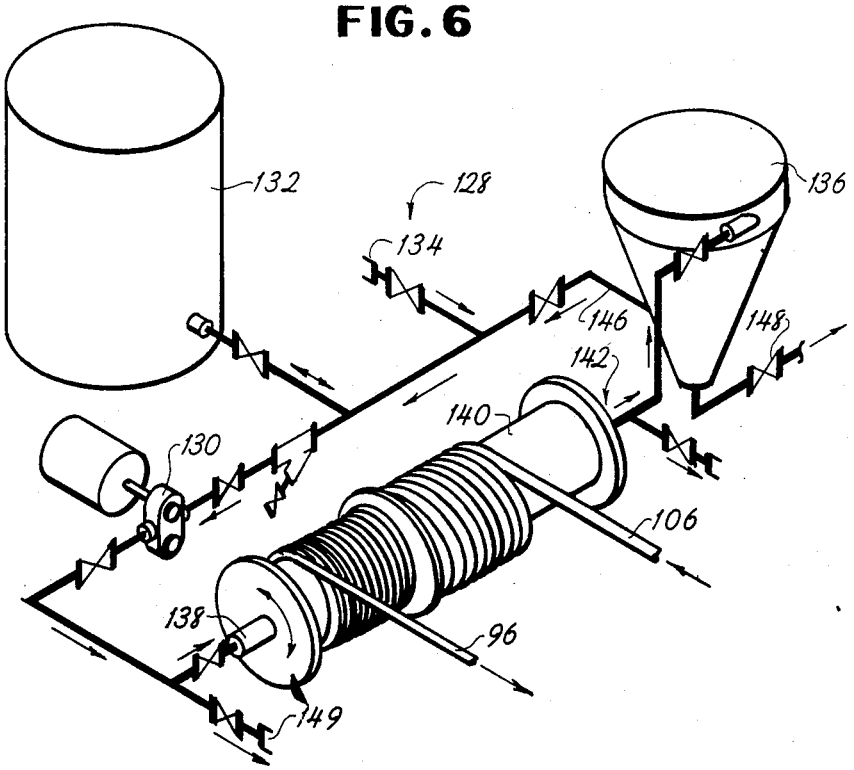
FIG. 7 is a perspective schematic diagram of a system for providing power and means for positioning the apparatuses depicted in FIGS. 5 and 6.

A system generally indicated at 128 in FIG. 7 is provided for powering and positioning the devices depicted in FIGS. 5 and 6 which serve to remove silt from the auger holes. This system 128 is positioned at a location remote from the auger hole and includes a high pressured pump 130 which supplied pressurized water through a flexible connector 138 on the hose reel 140 which carries the conduit 96. The water pumped by the pump 130 is derived from a storage tank 132 in the illustrated embodiment. Alternatively, a external source may be connected to the system through a hose connector 134. Moreover, water utilized in the system can be recycled by a filter 136 which removes the silt or other entrained particles from such water.

The pressurized flexible conduit 96 is attached to the devices 150 and 150' at locations 150 and 150', respectively. The conduit 106 mounted on the hose reel 140 and connected at 108 or 108' to the body members 78 or 78' return process effluent through a connector 142. This water is either expelled to a remote located through the hose connector 144 or passed for treatment in the effluent filter 136. If the water is treated by the filter 136 it is recycled and returned to the conduit 146 and the silt is expelled to a convenient storage location through the conduit 148. Additionally, a hose connector 149 is provided on the high pressured side of the pump 130 for connection to a manual high pressured hose which can be used to contact and dislocate silt blockages proximate the auger hole entry as by flushing.

In operation, the apparatus indicated at 128 in FIG. 7 is mounted on a truck or other suitable vehicle, and connected to the machine depicted in FIG. 5 or FIG. 6. This machine is placed within the cleared entry or mouth of the auger hole and the pump 130 is actuated. The jet action of the sparger 86 or 86' generates water streams which dislocate silt and propels the machine to the physical limits of the pressurized conduit 96 and 106 attached to the reel 140. It will be recognized by those skilled in the art that the hose reel 140 may be motorized as necessary or desired. The conduit 96 and 106 are slowly deployed permitting advancement of the machine into the hole. Simultaneously, silt entrained in a stream of water is expelled from the machine through the concurrently deployed effluent hose 106 and is either treated or recycled and expelled. The lowermost portion 50 of the machine depicted in FIG. 5 of the guard member 84 and 84' and/or the sparger rings of the machine will contact the silt 45 causing the machine to halt if the machine attempts to advance through the auger hole at a pace more rapid than the cleaning operation. The termination of the movement of the machine will cause a slackening of the hoses 96 and 106 which will signal the operator to stop the hose reel at least momentarily until the cleaning operation removes the silt which terminates the movement of the machine. As the streams **97*b* and 98*b* contact and erode the silt 45, the machine is free to progress, which in turn removes slack from the hoses 96 and 106** and signals the operator to continue the reel operation. In the event the hoses slacken and are not retightened the operator is notified that the extremity of the hole has been reached and that the hoses should be reeled in to remove the machine and terminate the cleaning operation.

Although the invention has been described in terms of an illustrated embodiment, many variations and modifications or changes will be apparent to those skilled in the art. Accordingly, this invention is intended to cover all such variations and modifications which fall within the spirit and scope of the appended claims.

What is claimed is:

1. A method for removing blockage and ore contaminants proximate the mouth of an auger hole, and for removing silt deposits from within said auger hole, said auger hole being a substantially horizontally disposed void created by mining a seam of ore such coal commencing at a highwall created during mining, said highwall being the external termination of said seam, such blockage, ore contaminants and silt being deleterious to reinitiating mining of a portion of remaining ore from said seam, said method comprising:

facing up said highwall by removing blockage and ore contaminants proximate and external to said auger hole;

removing blockage and ore contaminants from within said mouth of said auger hole whereby said mouth of said auger presence of said blockage and contaminants; and removing silt deposits from within said auger hole by directing a stream of water against said silt whereby said stream dislodges said silt and suspends said dislodged silt in said water, collecting said silt-laden water, and transporting said silt-laden water from the location of its collection to a location remote from said auger hole.

2. The method of claim 1 further comprising contacting said blockage of said auger hole with a high pressure stream of water from said auger hole cleaning device such that said blockage is suspended in said water, and transporting said blockage-laden water from said auger hole.

3. The method of claim 1 wherein said silt laden water is collected by the application of vacuum forces thereto for purposes of drawing said silt laden water from said auger hole.

4. The method claim 3 wherein said vacuum is produced by the emission of a high pressure stream of water to create a venturi effect.

5. The method of claim 1 wherein said silt laden water is filtered at a location remote from said auger hole such that said water can be recycled to provide a continuing water supply.

6. An apparatus suitable for being drivingly mounted on a conventional earth moving machine positioned upon a mine bench and for removing blockage from a auger hole which is a substantially horizontally disposed void created by mining a seam of coal or similar material commencing at a highwall created during mining, said highwall being the external termination of said seam, the mouth of said auger hole commencing at said highwall and continuing inwardly into said seam, said machine comprising:

a body member drivingly and releasibly connected to said conventional earth moving machine; and a blockage removing implement carried by said body member, said implement including a collapsible blade provided with an edge conforming substantially to the wall contour of said auger hole, said blade depolyed below said body member and being collapsible against said body member toward said earth moving machine during the insertion of said implement into said auger hole solely by the resistive action of said blockage against said blade within said auger hole during said insertion of said implement through said blockage, said blade being depolyed substantially perpendicularly to said body member solely by the resistive action of said blockage against said blade during the removal of said implement from said auger hole.

7. The machine as described in claim 6 wherein said body member is pivotally mounted to said conventional earth moving machine whereby said body member moves along the axis of said auger hole as it is driven by said earth moving machine regardless of the orientation of said axis to said bench.

8. A method for removing sloughing blockage proximate and within the mouth of an auger hole which is a substantially horizontally disposed void, said auger hole being created by mining in a seam of ore such as coal commencing at a highwall created during mining, said highwall being the external termination of said seam, such removal of blockage being preparatory to the mining of a portion of the remaining ore, in-situ mining, or preparatory to the placement of explosive charges in said auger hole, said method comprising:

facing up said highwall by removing said blockage proximate and external to the auger hole; and removing said blockage from within said mouth of said auger hole, whereby said mouth of said auger holes assumes its approximate cross-sectional outline prior to the presence of said blockage, by contacting said blockage within said auger hole with a high pressure steam of water such that said blockage is suspended in said water, and transporting said blockage-laden water from said auger hole.

9. A method for removing sloughing blockage and silt deposits proximate and within the mouth of an auger hole which is a substantially horizontally disposed void, said auger hole being created by mining in a seam of ore such as coal commencing at a highwall created during mining, said highwall being the external termination of said seam, such removal of blockage being preparatory to the mining of a portion of the remaining ore, in-situ mining, or preparatory to the placement of explosive charges in said auger hole, said method comprising:

facing up said highwall by removing said blockage proximate and external to said auger hole;

removing said blockage from within said mouth of said auger hole whereby said mouth of said mouth of said auger hole assumes its approximate cross-sectional outline prior ot the presence of said blockage; and removing said silt deposits from within said auger hole by contacting said silt deposits with a high pressure stream of water such that said silt deposits are suspended in said water, and collecting said silt-laden water by the application of vacuum forces thereto for purposes of drawing said silt-laden water from said auger hole.

10. A method for removing sloughing blockage and silt deposits proximate and within the mouth of an auger hole which is a substantially horizontally disposed void, said auger hole being created by mining in a seam of ore such as coal commencing at a highwall created during mining, said highwall being the external termination of said seam, such removal of blockage being preparatory to the mining of a portion of the remaining or, in-situ mining, or preparatory to the placement of explosive charges in said auger hole, said method comprising:

facing up said highwall by removing said blockage proximate and external to said auger hole;

removing blockage from within said mouth of said auger hole whereby said mouth of said auger hole assumes its approximate cross-sectional outline prior to the presence of said blockage; and removing said silt deposits from within said auger holes by contacting said silt deposits with a high pressure stream of water such that said silt deposits are suspended in said water, and collecting said silt-laden water by the application of vacuum forces thereto for purposes of drawing said silt-laden water from said auger hole, said vacuum forces being produced by the emission of said high pressure stream of water thereby creating a venturi effect.

11. A method for removing sloughing blockage and silt deposits proximate and within the mouth of an auger hole which is a substantially horizontally disposed void, said auger hole being created by mining in a seam of ore such as coal commencing at a highwall created during mining, said highwall being the external termination of said seam, such removal of blockage being preparatory of the mining of a portion of the remaining ore, in-siut mining, or preparatory to the placement of explosive charges in said auger hole, said method comprising:

facing up said highwall by removing blockage proximate and external to said auger hole;

removing blockage from within said mouth of said auger hole whereby said mouth of said auger hole assumes its approximate cross-sectional outline prior to the presence of said blockage;

removing said silt deposits from within said auger hole by contacting said silt deposits with a high pressure stream of water such that said silt deposits are suspended in said water, and transporting said slit-laden water from said auger hole to a location remote from said auger hole; and filtering said silt-laden water at said remote location such that said filtered water can be recycled to provide a continuing water supply.

* * * * *